US007278277B2

(12) United States Patent
Son

(10) Patent No.: US 7,278,277 B2
(45) **Date of Patent: *Oct. 9, 2007**

(54) ICE TRANSFER DEVICE FOR REFRIGERATOR, AND CONTROL CIRCUIT THEREOF

(75) Inventor: Sung Koo Son, Masan (KR)

(73) Assignee: LG Electronics Inc., Seoul (KR)

( * ) Notice: Subject to any disclaimer, the term of this patent is extended or adjusted under 35 U.S.C. 154(b) by 118 days.

This patent is subject to a terminal disclaimer.

(21) Appl. No.: 11/115,243

(22) Filed: Apr. 27, 2005

(65) Prior Publication Data

US 2005/0241330 A1 Nov. 3, 2005

(30) Foreign Application Priority Data

Apr. 28, 2004 (KR) ..... 10-2004-0029699

(51) Int. Cl.
*F25C 5/18* (2006.01)

(52) U.S. Cl. ..... 62/344

(58) Field of Classification Search ..... 62/344, 62/353

See application file for complete search history.

(56) References Cited

U.S. PATENT DOCUMENTS 5,037,004 A * 8/1991 Katz et al. ..... 222/146.6
6,637,217 B2 * 10/2003 Kim et al. ..... 62/125
6,758,047 B1 * 7/2004 Giles ..... 62/66

* cited by examiner

*Primary Examiner*—William E. Tapolcai
(74) *Attorney, Agent, or Firm*—Birch, Stewart, Kolasch & Birch LLP

(57) ABSTRACT

The present invention relates to an ice transfer device for a refrigerator, which can transfer ice made in an ice maker to a dispenser in the refrigerator, and a control circuit of the ice transfer device. The ice transfer device for a refrigerator according to the present invention comprises a storage container installed within the refrigerator to contain ice therein; a motor installed close to the storage container and having a motor shaft protruding in a direction opposite to a direction of transfer of the ice; a gearbox that is installed at a side opposite to a part for delivering the ice contained in the storage container to the outside, is connected to the motor shaft, and has a driving shaft protruding in the transfer direction of the ice to transmit a driving force while reducing a driving speed of the motor; and a transfer member installed within the storage container and connected to the driving shaft to push the ice forward by means of the driving of the motor. According to the present invention constructed as above, the formation of an unnecessary space in the interior of the refrigerator can be minimized, thereby improving the efficiency of use of a space.

7 Claims, 5 Drawing Sheets

ICE TRANSFER DEVICE FOR REFRIGERATOR, AND CONTROL CIRCUIT THEREOF

BACKGROUND OF THE INVENTION

1. Field of the Invention

The present invention relates to a refrigerator, and more particularly, to an ice transfer device for a refrigerator, which can transfer ice made in an ice maker to a dispenser in the refrigerator, and a control circuit of the ice transfer device.

2. Description of the Related Art

A conventional ice transfer device for a refrigerator will be described with reference to the accompanying drawings.

FIG. 1 shows a refrigerator with a conventional ice transfer device, and FIG. 2 is an enlarged view of the ice transfer device shown in FIG. 1.

As shown in these figures, a refrigerator body 1 is provided with a freezing chamber 3 that stores foodstuffs therein and is selectively opened or closed by a door 5. Further, a dispenser 7 is provided at a side of a front face of the door 5, and an ice maker 10 is installed at an upper portion of the freezing chamber 3.

As shown in FIG. 2, an ice-making part 11 for making ice i is provided at an upper portion of the ice maker 10. A storage container 13 for storing the ice i, which has been made by the ice-making part 11, is installed at a lower portion of the ice maker 10 that is below the ice-making part 11.

Meanwhile, a transfer member 15 for pushing stored ice i toward the front of the ice maker 10 is provided within the storage container 13. The transfer member 15 is formed helically and rotated by a motor 17 installed at the rear of the storage container 13. At this time, the motor 17 is arranged such that a motor shaft 17' is directed to the front of the ice maker 10. An AC shading motor is used as the motor 17.

A gearbox 19 is also provided between the transfer member 15 and the motor 17. The gearbox 19 comprises a plurality of gears to function to transmit increased driving torque to the transfer member 15 while reducing the driving speed of the motor 17. The gearbox 19 has a driving shaft 19' that is directed to the front of the ice maker 10 in the same manner as the motor shaft 17'. The gearbox 19 is connected to the transfer member 15 and the motor 17 by the driving shaft 19' and the motor shaft 17', respectively.

An ice-crushing member 21 is provided at a front end of the transfer member 15. The ice-crushing member 21 is to crush the ice i that is transferred to the front of the ice maker 10 by the transfer member 15. A delivery part 23 for delivering crushed ice i to the outside through the dispenser 7 is provided below the ice-crushing member 21.

However, the conventional ice transfer device for the refrigerator constructed as above has the following problems.

As described above, the motor 17 is conventionally installed at the rear of the storage container 13. Thus, there is a need for a space for the installation of the motor 17, which corresponds to the size of the motor 17, at the rear of the storage container 13. Since such a space is outside the storage container 13, it becomes a dead space in which ice i as well as foodstuffs cannot be stored. That is, the conventional ice transfer device has a disadvantage in that the space cannot be efficiently used.

Further, the conventional ice transfer device for the refrigerator employs an AC shading motor. The AC shading motor has problems in that the motor has heavy weight due to a shading coil thereof and is also difficult to output high power.

Furthermore, since the shading motor can rotate only in a forward direction but not rotate in a reverse direction in nature, the shading motor is difficult to operate if foreign substances and moisture are frozen over on the transfer member 15, the ice-crushing member 21 and the like due to low temperature. In such a case, the frozen foreign material and moisture should be melted after the operation of the refrigerator is stopped. With the use of a shading motor with higher power to solve the problem, the shading motor can be operated even though the freezing occurs to a certain extent. However, there are other problems in this case in that the thickness of a core of the shading motor increases and thus the overall size of the motor increases, electric power consumption increases, and production costs also increases.

SUMMARY OF THE INVENTION

Accordingly, the present invention is conceived to solve the aforementioned problems in the prior art. An object of the present invention is to provide a relatively compact ice transfer device for a refrigerator.

Another object of the present invention is to provide an ice transfer device for a refrigerator, wherein a DC motor is employed.

According to an aspect of the present invention for achieving the objects, there is provided a ice transfer device for a refrigerator, comprising: a storage container installed within the refrigerator to contain ice therein; a motor installed close to the storage container and having a motor shaft protruding in a direction opposite to a direction of transfer of the ice; a gearbox installed at a side opposite to a part for delivering the ice contained in the storage container to the outside and having a driving shaft protruding in the transfer direction of the ice to transmit a driving force while reducing a driving speed of the motor, the motor shaft being connected to the gearbox; and a transfer member installed within the storage container and connected to the driving shaft to push the ice forward by means of the driving of the motor.

Preferably, the motor is placed close to a position outside the storage container, the position being included in the coverage of a sectional area of the gearbox orthogonal to the transfer direction of the ice.

More preferably, at least one of edges of a bottom surface of the storage container is rounded, and the motor is installed in the vicinity of the rounded edge of the storage container.

More preferably, the motor is a DC motor.

According to other aspect of the present invention for achieving the objects, there is provided a control circuit of an ice transfer device for a refrigerator, wherein the ice transfer device comprises a DC motor installed below a storage container for storing ice therein and having a motor shaft protruding in a direction opposite to a direction of transfer of the ice so as to generate a driving force for transferring the ice, and a gearbox installed at a side opposite to a part for delivering the ice contained in the storage container to the outside and having a driving shaft protruding in the transfer direction of the ice to transmit a driving force while reducing a driving speed of the motor, the motor shaft being connected to the gearbox; the DC motor has a voltage specification similar to an external AC voltage; and a rectifying circuit is provided between the DC motor and an external AC voltage input terminal.

Preferably, the rectifying circuit comprises a bridge diode.

More preferably, a smoothing element for smoothing an output voltage of the rectifying circuit is further provided between the rectifying circuit and the DC motor.

More preferably, the smoothing element comprises a capacitor.

BRIEF DESCRIPTION OF THE DRAWINGS

The above and other objects, features and advantages of the present invention will become apparent from the following description of preferred embodiments given in conjunction with the accompanying drawings, in which.

DESCRIPTION OF THE PREFERRED EMBODIMENT

Hereinafter, preferred embodiments of an ice transfer device for a refrigerator and a control circuit thereof according to the present invention will be described in detail with reference to the accompanying drawings.

Figure 1:
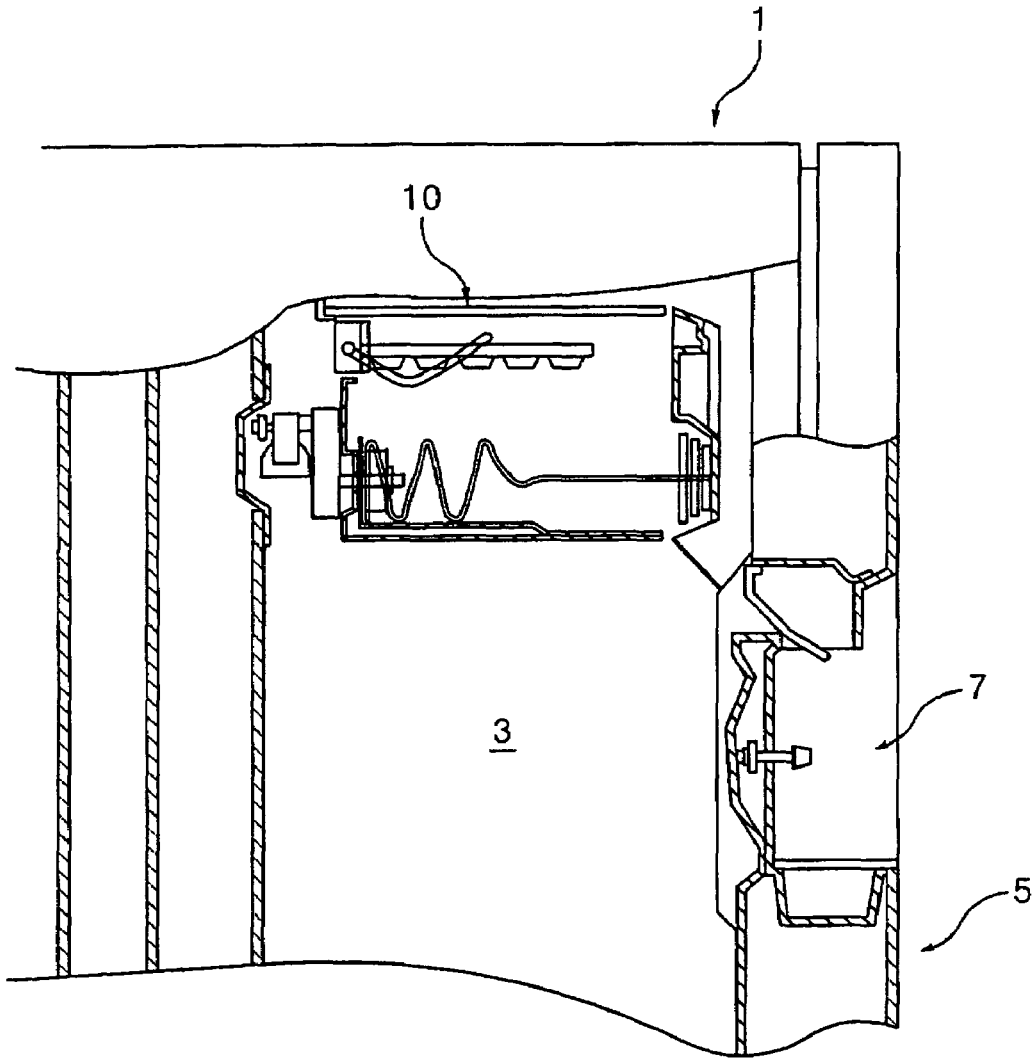
FIG. 1 Related Art
FIG. 1 is a sectional side view of a portion of a refrigerator with a conventional ice transfer device.
Figure 2:
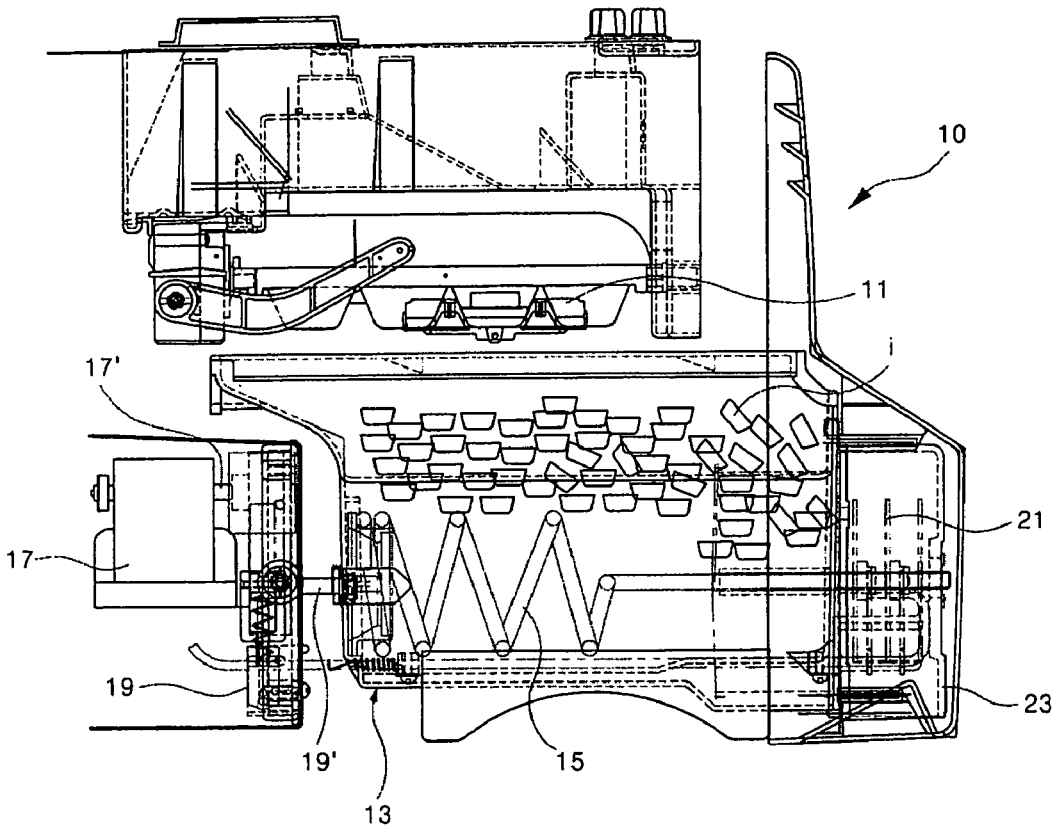
FIG. 2 Related Art
FIG. 2 is an enlarged view of the ice transfer device shown in FIG. 1.
Figure 3:
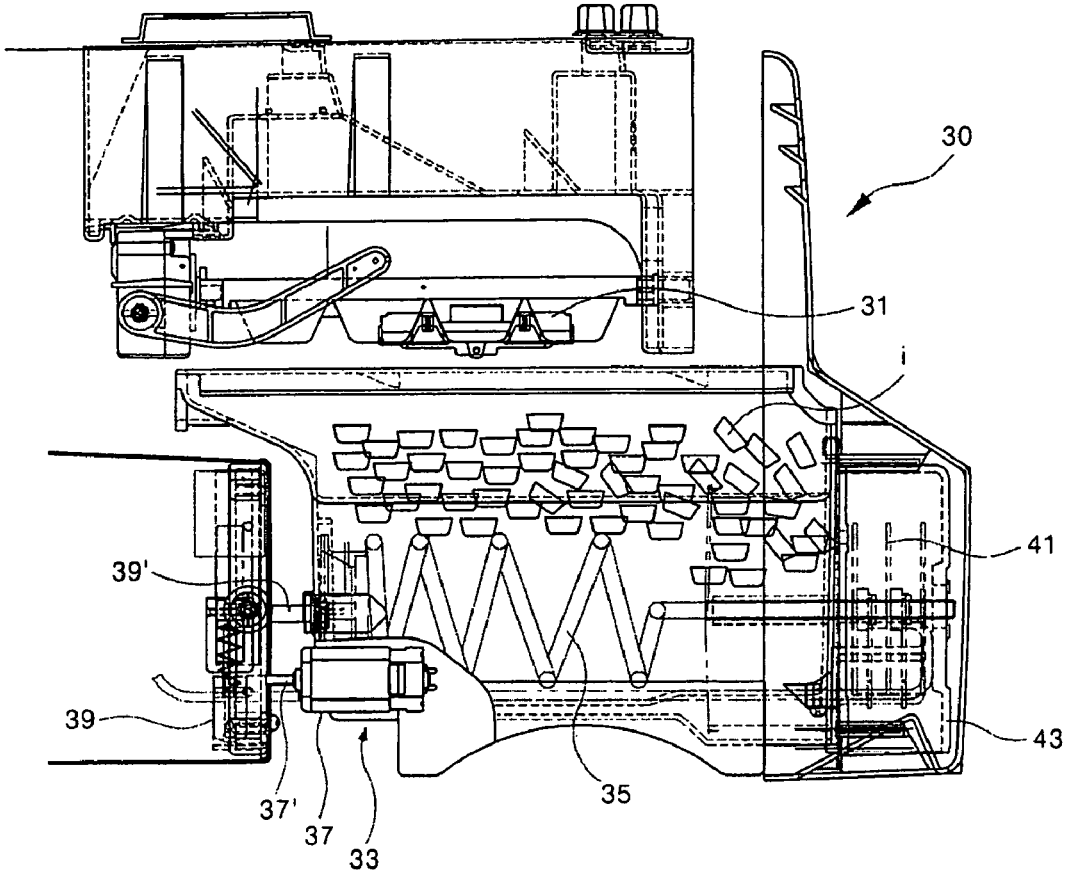
FIG. 3 is a sectional side view of an ice transfer device according to a preferred embodiment of the present invention.
Figure 4:
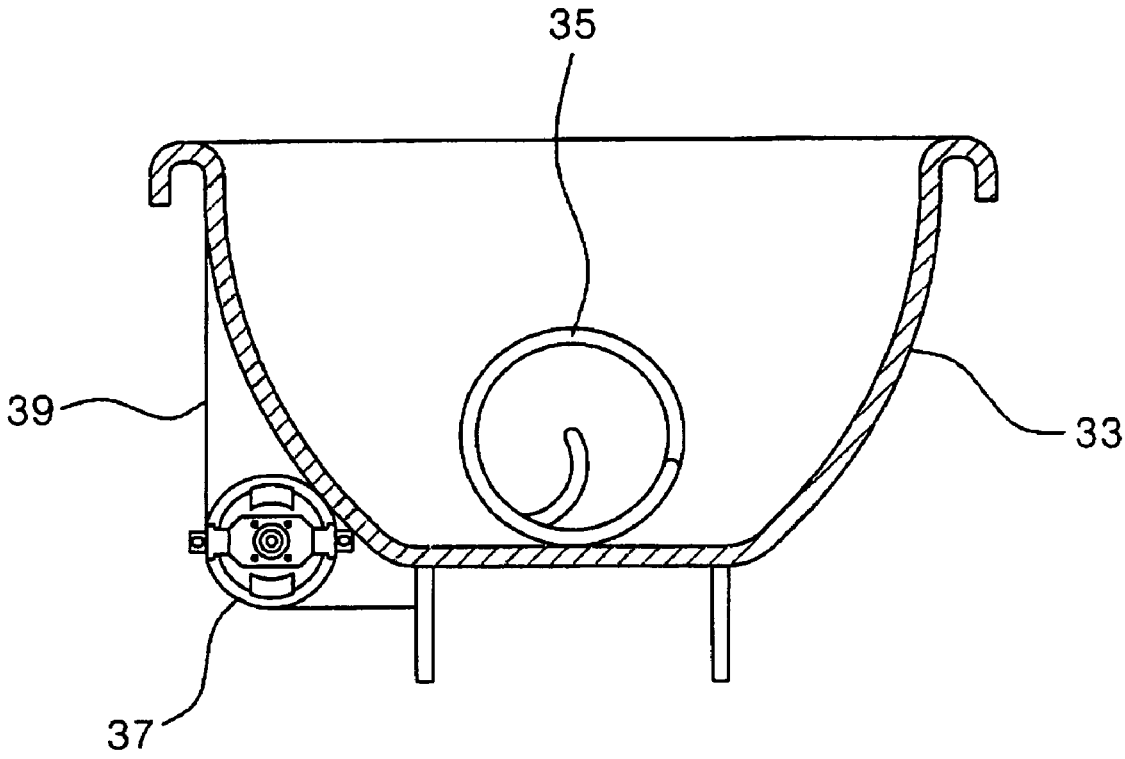
FIG. 4 is a front sectional view of the ice transfer device of the embodiment shown in FIG. 3.

FIGS. 3 and 4 show an ice transfer device for a refrigerator according to a preferred embodiment of the present invention.

As shown in these figures, an ice-making part 31 for making ice i is provided at an upper portion of an ice maker 30, and a storage container 33 is provided below the ice-making part 31. The storage container 33 is to store the ice i that has been made by the ice-making part 31. Both edges of a bottom surface of the storage container 33 are rounded as shown in FIG. 4.

Meanwhile, a transfer member 35 is provided within the storage container 33. The transfer member 35 is to push ice i, which has been stored in the storage container 33, toward the front of the ice maker 30. The transfer member 35 is installed to extend in a fore and aft direction of the storage container 33 in the vicinity of the bottom surface of the storage container 33. The transfer member 35 is helically formed and pushes the ice i while being rotated.

Further, a motor 37 for rotating the transfer member 35 is provided. The motor 37 is installed below the storage container 33, more specifically, close to one of the rounded edges of the bottom surface of the storage container 33. The motor 37 has a motor shaft 37' that protrudes toward the rear of the ice maker 30, i.e. in a direction opposite to the transfer direction of the ice i.

At this time, it is preferred that a DC motor relatively smaller than a conventional motor be used as the motor 37.

With the use of the DC motor as the motor 37, as well shown in FIG. 4, the motor 37 is installed not to protrude beyond a lower end or a side end of the storage container 33. For reference, the motor 37 may be installed in a space defined between the storage container 33 and a gearbox 39, which will be described below, such that the motor does not protrude beyond them. That is, the motor 37 is positioned adjacent to a region outside the storage container 33, which is included in the coverage of a sectional area of the gearbox 39 perpendicularly to the transfer direction of the ice.

The gearbox 39 comprising a plurality of gears is installed at the rear of the storage container 33. The gearbox 39 functions to transmit increased driving torque to the transfer member 35 while reducing the driving speed of the motor 37. The gearbox 39 has a driving shaft 39', which protrudes at the front thereof toward the front of the storage container 33, i.e., in the transfer direction of the ice i, is connected to the transfer member 35 and receives power from the motor 37 via the motor shaft 37'.

An ice-crushing member 41 is provided at a front end of the transfer member 35. The ice-crushing member 41 is to crush the ice i that is moved to the front of the storage container 33 by the transfer member 35. A delivery part 43 is provided below the ice-crushing member 41 to deliver crushed ice i through the dispenser 7.

Figure 5:
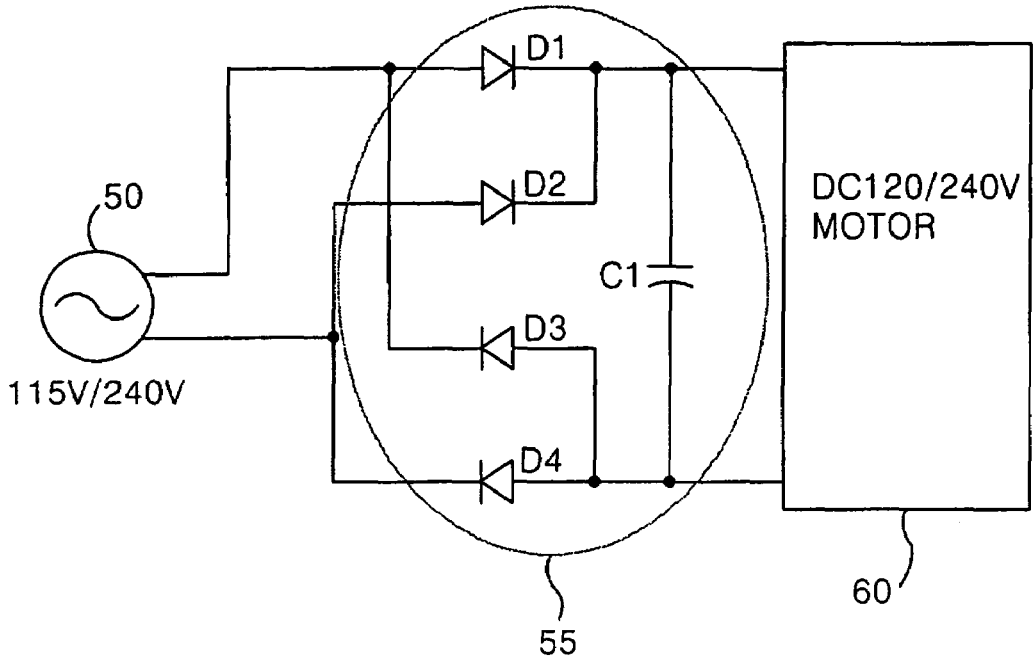
FIG. 5 is a diagram of a control circuit of the ice transfer device according to the present invention.

Next, FIG. 5 shows the configuration of a control circuit of the ice conveyer for a refrigerator according to the present invention.

Referring to the figure, the present invention employs the DC motor 37 operable at 120V or 240V. As for the DC motor 37, a 120V DC motor is used when an AC voltage input from the outside is about 110V (110±10V), while a 240V DC motor is used when an AC voltage input from the outside is about 240V (240±10V). That is, since the present invention employs the DC motor operable at a voltage identical or similar to an external AC voltage, there is no need for voltage-dividing control by which an input voltage is adjusted to be adapted to the voltage of the DC motor.

Thus, the present invention comprises only a rectifying circuit 55, which converts an AC input voltage into a DC voltage, between the DC motor 37 and an external AC voltage input terminal 50. The rectifying circuit 55 is a bridge diode comprising four diodes D1 to D4, and includes a capacitor C1 as a smoothing circuit for smoothing an output voltage of the bridge diode. The rectifying circuit 55 need not be limited to a bridge diode, and any devices for rectifying an input AC voltage may be appropriately used as the rectifying circuit 55. In addition, the smoothing circuit need not be also limited to a capacitor, and any devices for smoothing an input voltage may be appropriately used as the smoothing circuit.

Next, the operation of the ice transfer device for the refrigerator according to the preferred embodiment of the present invention will be described.

As for the process of delivering ice i in the ice maker 30, ice i made by the ice-making part 31 first falls down and is stored in the storage container 33. When a user manipulates the dispenser 7, the motor 37 is operated. With the operation of the motor 37, the transfer member 35 is rotated and pushes the ice i to the front of the ice maker 30.

Meanwhile, the ice i that has been moved to the front of the ice maker 30 by the transfer member 35 is crushed by the ice-crushing member 41. The ice i, which has been crushed to certain sizes by the ice-crushing member 41, is delivered through the dispenser via the delivery part 43 provided below the ice-crushing member 41.

At this time, the motor 37 is installed below the storage container 33 in the vicinity of one of the rounded edges of the bottom surface of the storage container 33, and only the gearbox 39 is installed at the rear of the storage container 33. Thus, it is possible to maximally use a space formed between the ice maker 30 and a back surface of the freezing chamber in which the ice maker 30 is installed.

Meanwhile, in the control circuit of the present invention, a voltage specification of the motor 37 is a rated DC 115V or DC 240V. An external input voltage is identical or similar to AC 115V or AC 240V.

Thus, an AC voltage input from the power input terminal 50 is converted into a DC voltage through the rectifying circuit 55, and then, the converted DC voltage is input into the DC motor 37 without voltage division.

That is, since the DC motor with the voltage specification identical or similar to an external AC voltage is used, there is no need for an additional configuration for dividing a voltage.

It will be apparent that those skilled in the art can make other modifications within the fundamental technical spirit of the present invention. The scope of the present invention should be construed based on the appended claims.

For example, although both sides of the bottom surface of the storage container 33 are curved in the illustrated embodiment, it is not necessarily so. Only one of the sides of the bottom surface in which the motor 37 is installed may be curved.

With the ice transfer device for the refrigerator according to the present invention described above, the formation of an unnecessary space in the interior of the refrigerator can be minimized, thereby improving the efficiency of use of a space.

In addition, since the 120V or 240V DC motor is employed in the present invention, it is not necessary to use a capacitor for voltage division in the control circuit, and an input voltage can be directly used only after rectification thereof. With such a configuration, the present invention has advantages in that material costs are reduced and the configuration of the circuit is simplified.

What is claimed is:

1. A control circuit of an ice transfer device for a refrigerator, wherein ice transfer device comprises a DC motor installed below a storage container for storing ice therein and having a motor shaft protruding in a direction opposite to a direction of transfer of the ice so as to generate a driving force for transferring the ice, and a gearbox installed at a side opposite to a part for delivering the ice contained in the storage container to the outside and having a driving shaft protruding in the transfer direction of the ice to transmit a driving force while reducing a driving speed of the motor, the motor shaft being connected to the gearbox, said control circuit comprising;

the DC motor having a voltage specification similar to an external AC voltage; and a rectifying circuit provided between the DC motor and an external AC voltage input terminal.

2. The control circuit as claimed in claim 1, wherein the rectifying circuit comprises a bridge diode.

3. The control circuit as claimed in claim 1, further comprising; a smoothing element for smoothing an output voltage of the rectifying circuit provided between the rectifying circuit and the DC motor.

4. The control circuit as claimed in claim 3, wherein the smoothing element comprises a capacitor.

5. An ice transfer device for a refrigerator, comprising:

an ice storage container;

a helical ice transfer member having a longitudinal axis to move ice located in the storage container in a first direction toward one side of the storage container along the longitudinal axis;

a motor located adjacent the storage container having a drive shaft adapted to actuate the ice transfer member, said drive shaft having an axis that is substantially parallel to the longitudinal axis of the helical ice transfer member and the drive shaft extends from the motor in a direction opposite to the direction of ice movement by the transfer member; and a gearbox installed at a side opposite to a part for delivering the ice contained in the storage container to the outside and having a driving shaft protruding in the transfer direction of the ice to transmit a driving force while reducing a driving speed of the motor, the motor shaft being connected to the gearbox, wherein the helical transfer member is installed within the storage container and connected to the driving shaft of the gearbox to push the ice forward by the driving of the motor.

6. The device as claimed in claim 5, wherein the motor is a DC motor.

7. The ice transfer device of claim 5, wherein the motor is located adjacent to a bottom portion of the ice storage container.

* * * * *